US010919720B2

(12) United States Patent
Fuchi et al.

(10) Patent No.: US 10,919,720 B2
(45) Date of Patent: Feb. 16, 2021

(54) SHEET CONVEYANCE UNIT AND SHEET CONVEYANCE SYSTEM INCLUDING SAME

(71) Applicant: KYOCERA Document Solutions Inc., Osaka (JP)

(72) Inventors: Masami Fuchi, Osaka (JP); Masayuki Kakuta, Osaka (JP); Sachio Izumichi, Osaka (JP); Seiji Okada, Osaka (JP); Risa Hibino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 180 days.

(21) Appl. No.: 16/359,205

(22) Filed: Mar. 20, 2019

(65) Prior Publication Data

US 2019/0300320 A1 Oct. 3, 2019

(30) Foreign Application Priority Data

Mar. 29, 2018 (JP) ..... 2018-063663

(51) Int. Cl.

| | |
|---|---|
| ***B65H 5/38*** | (2006.01) |
| ***B65H 29/12*** | (2006.01) |
| ***B65H 29/60*** | (2006.01) |
| ***B65H 29/52*** | (2006.01) |

(52) U.S. Cl.

CPC ..... *B65H 5/38* (2013.01); *B65H 29/125* (2013.01); *B65H 29/52* (2013.01); *B65H 29/60* (2013.01); *B65H 2404/657* (2013.01); *B65H 2404/74* (2013.01)

(58) Field of Classification Search

CPC ... B65H 5/00; B65H 5/36; B65H 5/38; B65H 2402/62; B65H 2404/6112; B65H 2404/657; B65H 2404/74; B65H 2404/741; B65H 2404/7414; B65H 2404/743; B65H 29/52

See application file for complete search history.

(56) References Cited

U.S. PATENT DOCUMENTS

2002/0163118 A1* 11/2002 Inoue ..... B65H 5/38 271/162
2009/0212493 A1* 8/2009 Sugahara ..... G07D 11/40 271/272

(Continued)

FOREIGN PATENT DOCUMENTS

JP 2014-206717 A 10/2014

*Primary Examiner* — Prasad V Gokhale
(74) *Attorney, Agent, or Firm* — Stein IP, LLC

(57) ABSTRACT

A sheet conveyance unit includes a sheet inlet port, an inlet guide, and a guide switching mechanism. The inlet guide has an upper guide and a lower guide below the upper guide. The guide switching mechanism switches a position of the inlet guide between a conveyance position at which the upper guide and the lower guide face each other with a first distance and a separation position at which the upper guide and the lower guide are spaced from each other by a second distance greater than the first distance. To connect the sheet conveyance unit to the sheet discharge unit, the inlet guide is disposed to the separation position before the discharge guide is inserted between the upper guide and the lower guide, and is disposed to the conveyance position after the discharge guide is inserted between the upper guide and the lower guide.

7 Claims, 8 Drawing Sheets

(56) References Cited

U.S. PATENT DOCUMENTS

| | | | | |
|---|---|---|---|---|
| 2010/0314823 | A1* | 12/2010 | Terao | B65H 29/125<br>271/3.14 |
| 2011/0215517 | A1* | 9/2011 | Mizutani | G03G 15/6552<br>271/109 |
| 2014/0270837 | A1 | 9/2014 | Okumura et al. | 399/90 |

* cited by examiner

SHEET CONVEYANCE UNIT AND SHEET CONVEYANCE SYSTEM INCLUDING SAME

INCORPORATION BY REFERENCE

This application is based upon and claims the benefit of priority from the corresponding Japanese Patent Application No. 2018-63663 filed on Mar. 29, 2018, the entire contents of which are incorporated herein by reference.

BACKGROUND

The present disclosure relates to a sheet conveyance unit which is attachably and detachably connected to an upstream-side apparatus, such as an image forming apparatus, and which conveys a sheet received from the upstream-side apparatus to a downstream side, and also relates to a sheet conveyance system including the same.

Conventionally, sheet post-processing apparatuses are known which are capable of performing sheet post-processing, such as binding processing of stacking a plurality of sheets on each of which an image has been formed by an image forming apparatus such as a copier, a printer, or the like and binding the stacked plurality of sheets together as a sheet bunch by means of a stapler, punch-hole forming processing of punching a hole by means of a punch-hole forming device, and so forth, and such sheet post-processing apparatuses are used to perform the sheet post-processing such as the binding processing with respect to a comparatively large number of sheets.

Such sheet post-processing apparatuses are each provided with a sheet inlet port for receiving a sheet discharged via a sheet discharge port of an image forming apparatus. Here, the image forming apparatus may, for example, sink into a carpet laid on the floor, which sometimes creates a state where the sheet discharge port of the image forming apparatus and the sheet inlet port of the sheet post-processing apparatus are located at different height positions. Conventionally, such difference in height position between the sheet discharge port and the sheet inlet port has generally been compensated for by increasing the width of a conveyance guide on the upstream side (sheet discharge port side), the conveyance guide constituting the sheet inlet port of the sheet post-processing apparatus.

However, the increase in the width of the conveyance guide constituting the sheet inlet port may cause a soft sheet such as a thin paper sheet to curl at the sheet inlet port, and the thus curled thin paper sheet cannot be conveyed into the sheet inlet port smoothly, which disadvantageously results in paper jam. On the other hand, if the width of the conveyance guide is reduced, it becomes necessary to adjust the heights of the image forming apparatus and the sheet post-processing apparatus with good accuracy, which disadvantageously increases the time for the installation of the image forming apparatus and the sheet post-processing apparatus.

Here, as a method for smoothly achieving connection between an image forming apparatus and a sheet post-processing apparatus, there is known, for example, combined units including a first unit to which there is attached a fixed member on which a first connector is mounted, and a second unit to which there is attached a connection member on which a second connector is mounted. The connection member is movable in a front-back direction and configured to be switchable in position between a connection position at which the connection member is engaged with the fixed member and a release position at which the connection member is disengaged from the fixed member.

The first connector and the second connector are connected to each other when the connection member is located at the connection position, and disconnected from each other when the connecting member is located at the release position.

SUMMARY

According to one aspect of the present disclosure, a sheet conveyance unit being connected to a sheet discharge unit which discharge a sheet, includes a sheet inlet port, an inlet guide, and a guide switching mechanism. The sheet inlet port is connected to a discharge guide provided in the sheet discharge unit. The inlet guide is provided at the sheet inlet port, and has an upper guide facing an upper surface of the sheet and a lower guide disposed below the upper guide and so as to face a lower surface of the sheet. The guide switching mechanism switches a position of the inlet guide between a conveyance position at which the upper guide and the lower guide face each other with a first distance and a separation position at which the lower guide and the upper guide are spaced from each other with a second distance greater than the first distance. The inlet guide is disposed to the separation position before the discharge guide is inserted between the upper guide and the lower guide, and the position of the inlet guide is disposed to the conveyance position after the discharge guide is inserted between the upper guide and the lower guide.

Still other objects of the present disclosure and specific advantages provided by the present disclosure will become further apparent from the following descriptions of embodiments.

DETAILED DESCRIPTION

Figure 1:
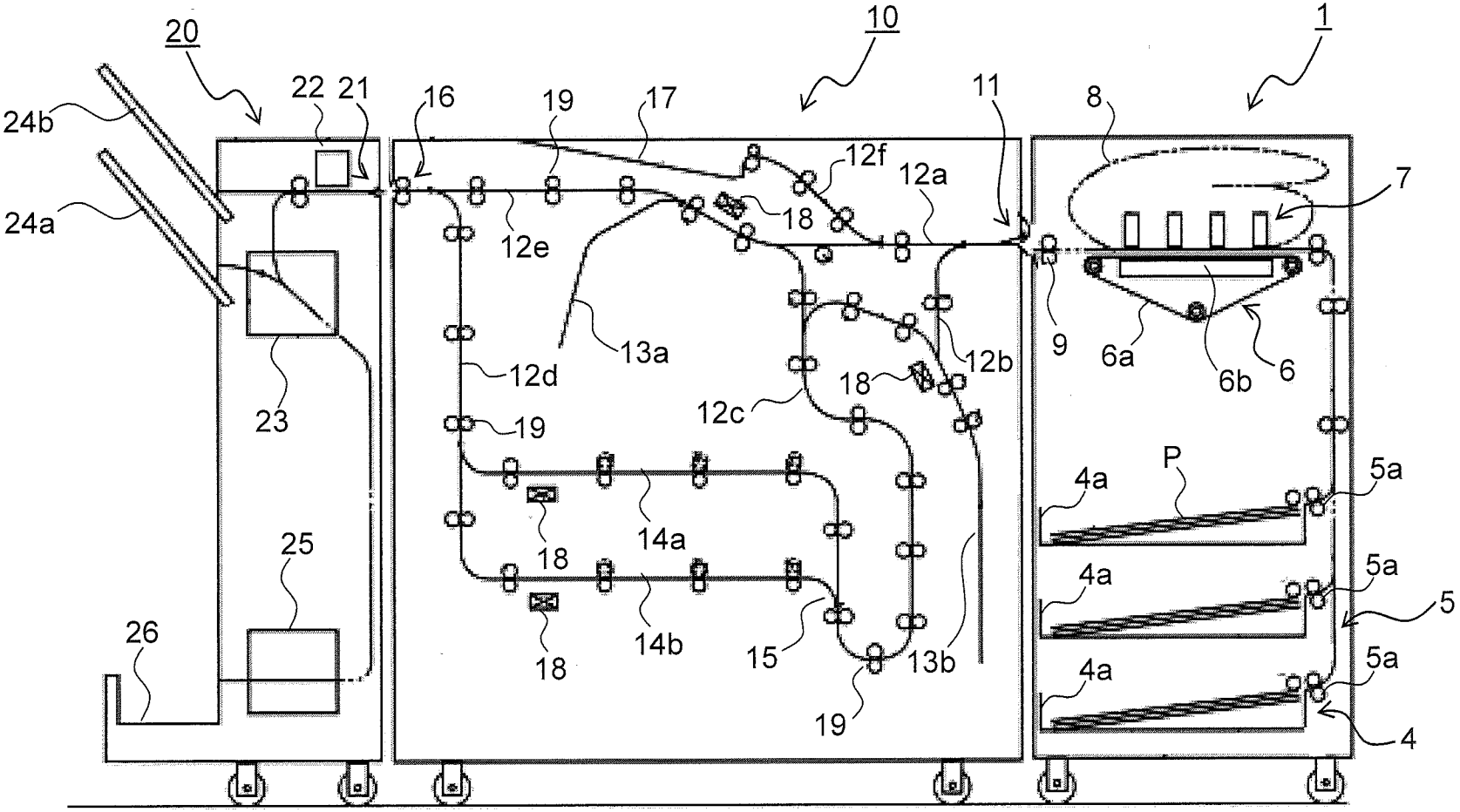
FIG. 1 is a schematic diagram illustrating a configuration inside an image forming apparatus, a relay conveyance apparatus, and a sheet post-processing apparatus, which are included in an image forming system.

Hereinafter, embodiments of the present disclosure will be described with reference to the drawings. FIG. 1 is a schematic diagram illustrating a configuration inside an image forming apparatus (sheet discharge unit) 1, a relay conveyance apparatus (sheet conveyance unit) 10, and a sheet post-processing apparatus 20, which are included in an image forming system. First, with reference to FIG. 1, a description will be give of the image forming system including the image forming apparatus 1, the relay conveyance apparatus 10 as an example of the sheet conveyance unit of the present disclosure, and the sheet post-processing apparatus 20.

The image forming apparatus 1 is a printer of an inkjet recording type, and includes a sheet storage section 4 arranged in a lower portion of the image forming apparatus 1, a sheet feeding section 5 arranged beside and above the sheet storage section 4, a sheet conveyance section 6 arranged above the sheet storage section 4, an image recording section 7 disposed above and opposite the sheet conveyance section 6, and a reverse conveyance section 8 provided above the image recording section 7.

The sheet storage section 4 is provided with a plurality of (here, three) attachable/detachable sheet feeding cassettes 4*a* in which a bundle of paper sheets P are stacked. The sheet feeding section 5 feeds a paper sheet P placed in the sheet storage section 4 to the sheet conveyance section 6 by means of a sheet feeding roller pair 5*a*, which is provided on a downstream side of each sheet feeding cassette 4*a* in a sheet feeding direction.

The sheet conveyance section 6 includes a conveyance belt 6*a* which is an endless belt wound around a plurality of rollers including a driving roller. The conveyance belt 6*a* is provided with a large number of air holes (not shown) through which air is sucked in. The paper sheet P fed out of the sheet feeding section 5 passes below the image recording section 7, during which the paper sheet P is adsorbed and held on the conveyance belt 6*a* by being sucked by a sheet sucking section 6*b* provided inside the conveyance belt 6*a*.

The image recording section 7 includes a plurality of inkjet heads which eject ink toward the paper sheet P conveyed by being adsorbed and held on the conveyance belt 6*a*. To each of the inkjet heads, ink of one of four colors (cyan, magenta, yellow, and black) stored in an ink tank (not shown) is supplied corresponding to the color of each of the inkjet heads.

In a case where recording is to be performed on both sides of the paper sheet P, after recording is finished on one side of the paper sheet P, the reverse conveyance section 8 switches the conveyance direction of the paper sheet P (that is, switches back the paper sheet P) to thereby turn the paper sheet P over, and then conveys the paper sheet P to the image recording section 7 with the side of the paper sheet P on which no image has been recorded facing upward. The paper sheet P on which predetermined images have been recorded by the image recording section 7 is discharged via a discharge roller pair 9, and conveyed into the relay conveyance apparatus 10.

The relay conveyance apparatus 10 performs reversing processing of turning over the paper sheet P after an image is recorded on the paper sheet P by the image forming apparatus 1, and drying processing of drying ink on the paper sheet P. As illustrated in FIG. 1, the paper sheet P conveyed into the relay conveyance apparatus 10 via a relay inlet port (sheet inlet port) 11 passes through a first conveyance path 12*a* to be conveyed onto a first reversing tray 13*a*. The first reversing tray 13*a* receives the paper sheet P conveyed from the first conveyance path 12*a*, and then turns the paper sheet P over by switching the conveyance direction of (that is, by switching back) the paper sheet P.

Further, there is provided a second conveyance path 12*b* which branches off from the first conveyance path 12*a*, and the paper sheet P having passed through the second conveyance path 12*b* is conveyed onto a second reversing tray 13*b*. The second reversing tray 13*b* receives the paper sheet P conveyed from the second conveyance path 12*b*, and then turns the paper sheet P over by switching the conveyance direction of (that is, by switching back) the paper sheet P.

The paper sheet P, which has been turned over by the first reversing tray 13*a* or the second reversing tray 13*b* passes through a third conveyance path 12*c* to be conveyed to a bypass conveyance path 14*a* or 14*b*. The bypass conveyance paths 14*a* and 14*b* are capable of making the paper sheet P stop (stand by) in accordance with what processing the sheet post-processing apparatus 20 is going to perform. Sheet stopping positions (that is, the horizontal portions in FIG. 1) of the bypass conveyance paths 14*a* and 14*b* are at different distances from a branching section 15, and thus, for example, by stopping a first paper sheet P having been turned over by the first reversing tray 13*a* within the bypass conveyance path 14*a* and stopping a second paper sheet P having been turned over by the second reversing tray 13*b* within the bypass conveyance path 14*b*, it is possible to restart conveying the once stopped paper sheets P with the distance therebetween maintained.

The paper sheet P having passed through the bypass conveyance path 14*a* or 14*b* passes through a fourth conveyance path 12*d*, and is discharged from a relay outlet port 16 to be conveyed into the sheet post-processing apparatus 20. In a case of conveying the paper sheet P into the sheet post-processing apparatus 20 without performing the reversing processing, the paper sheet P passes through a fifth conveyance path 12*e* which branches off from the first conveyance path 12*a* on an upstream side of the first reversing tray 13*a*, and is discharged from the relay outlet port 16. The paper sheet P that is not to be conveyed into the sheet post-processing apparatus 20 passes through a sixth conveyance path 12*f* branching off from the first conveyance path 12*a*, and is discharged onto a relay discharge tray 17.

In each of the first conveyance path 12*a*, the second conveyance path 12*b*, and the bypass conveyance paths 14*a* and 14*b*, a fan 18 is disposed for sending air to the paper sheet P to dry the ink thereon. In each of the first to sixth conveyance paths 12*a* to 12*f* and the bypass conveyance paths 14*a* and 14*b*, a conveyance roller pair (conveyance member) 19, which conveys the paper sheet P, is disposed at a suitable position.

The sheet post-processing apparatus 20 is connected to the relay conveyance apparatus 10 on the downstream side of the relay conveyance apparatus 10 in the conveyance direction, and performs the post-processing such as the punch-hole forming processing, binding processing, or the like with respect to paper sheets P on which images have been recorded in the image forming apparatus 1 and which have passed through the relay conveyance apparatus 10.

As illustrated in FIG. 1, inside the sheet post-processing apparatus 20, there are provided a punch-hole forming device 22 which performs punch-hole forming with respect to the paper sheet P which has been conveyed from the sheet inlet port 21, an end-binding unit 23 which stacks a plurality of paper sheets P having been received while aligning end portions of the stacked paper sheets P and binds the stacked paper sheets P with a staple, and a middle-binding middle-folding unit 25 which performs stapling processing on a center of the stacked paper sheets P to then fold the stacked paper sheets P into a booklet form at the stapled portion as the center. On a side surface of the sheet post-processing apparatus 20, there are provided a main tray 24*a* which can be ascended and descended to a position suitable to receive a discharged paper sheet P, and a sub tray 24*b* which is fixed to an upper portion of the sheet post-processing apparatus 20.

The punch-hole forming device 22 is disposed in an upper portion of the sheet post-processing apparatus 20. The paper sheet P on which an image has been formed in the image forming apparatus 1 is fed into the sheet post-processing apparatus 20 via the sheet inlet port 21 provided in an upper right portion of the sheet post-processing apparatus 20 to pass through the punch-hole forming device 22, and then, in a case where no stapling processing is to be performed, the paper sheet P is discharged as it is into the sub tray 24*b*. In a case where the staple processing is to be performed, the paper sheet P is conveyed to the end-binding unit 23 or the middle-binding middle-folding unit 25, of which both are disposed below the punch-hole forming device 22.

The end-binding unit 23 includes a stapler, a processing tray (of which neither is illustrated), etc. A bundle of paper sheets P are stacked on the processing tray with leading ends of the paper sheets P aligned, the stapler disposed at an end portion of the processing tray binds the bundle of paper sheets P at an end of the bundle, and then the bundle of the paper sheets P is discharged along the processing tray onto the main tray 24*a*.

The middle-binding middle-folding unit 25 disposed below the end-binding unit 23 includes a middle-binding stapler, a middle-folding device, a sheet guide (of which none is illustrated), etc. The middle-binding stapler performs stapling processing on a center portion of the bundle of paper sheets P stacked inside the sheet guide. The bundle of paper sheets P having undergone the staple processing performed by the middle-binding stapler is folded into a booklet form by the middle-folding device with the stapled portion as the center, and is then discharged into a booklet tray 26.

Figure 2:
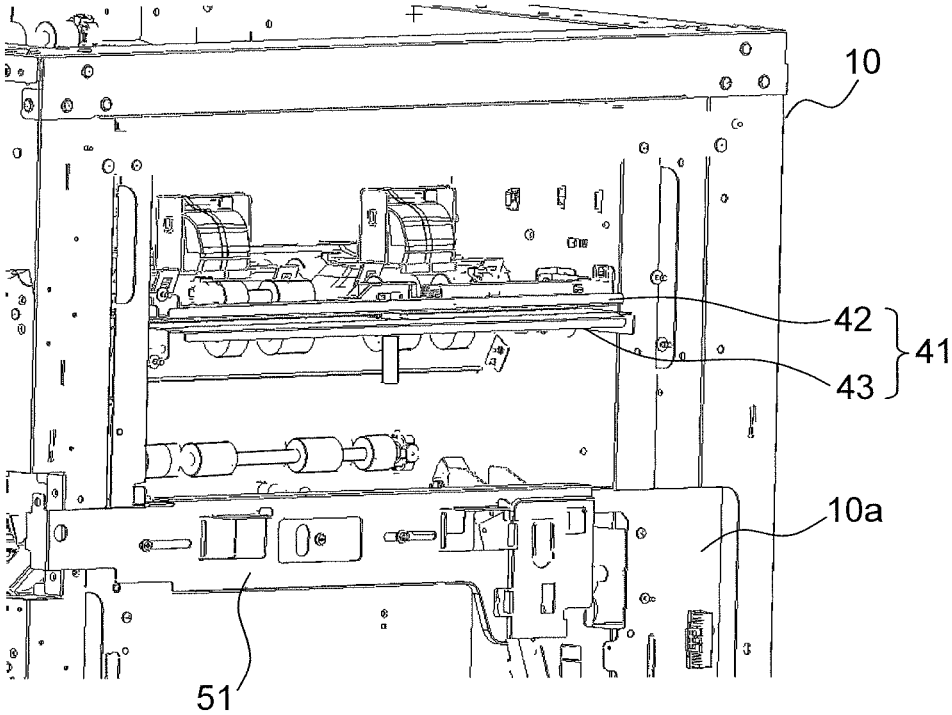
FIG. 2 is a perspective view of the relay conveyance apparatus as seen from the image forming apparatus side, illustrating a state in which an upper guide and a lower guide are disposed at a conveyance position.
Figure 3:
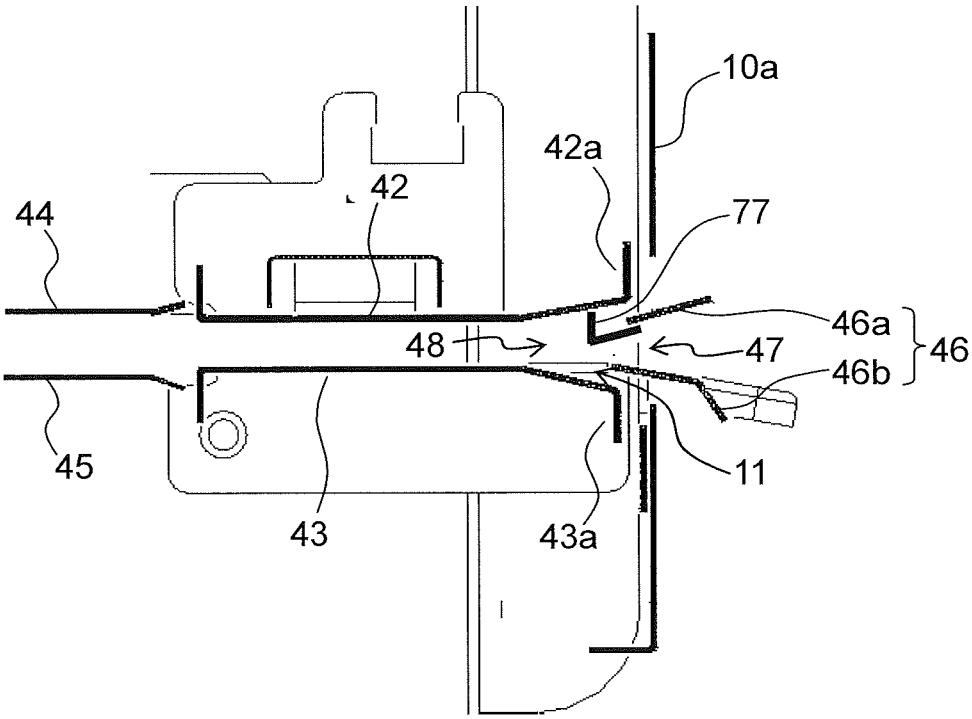
FIG. 3 is a side sectional view of the relay conveyance apparatus taken near a relay inlet port, illustrating a state in which the upper guide and the lower guide are disposed at the conveyance position.

FIG. 2 is a perspective view around a relay inlet port 11 of the relay conveyance apparatus 10 according to an embodiment of the present disclosure, as seen from the image forming apparatus 1 side. FIG. 3 is a side sectional view near the relay inlet port 11 of the relay conveyance apparatus 10 according to the present embodiment. Here, FIG. 2 illustrates a state in which part of a side surface frame 10*a* facing the image forming apparatus 1 is removed for visibility of an inside of the relay conveyance apparatus 10. As illustrated in FIG. 2, the relay conveyance apparatus 10 includes an inlet guide 41 disposed at the relay inlet port 11 (see FIG. 1), and a guide switching mechanism 50 (see FIG. 5) which switches the space in the inlet guide 41. A detailed configuration of the guide switching mechanism 50 will be described later.

The inlet guide 41 includes an upper guide 42 and a lower guide 43, which is disposed below the upper guide 42. The upper guide 42 and the lower guide 43 respectively face an upper surface and a lower surface of the paper sheet P conveyed into the relay conveyance apparatus 10. On a downstream side (left side in FIG. 3) of the inlet guide 41 with respect to the conveyance direction, there are disposed upper conveyance guide 44 and a lower conveyance guide 45 which respectively face the upper surface and the lower surface of the paper sheet P. The upper conveyance guide 44 and the lower conveyance guide 45 define a conveyance surface (conveyance guide) of the first conveyance path 12*a* (see FIG. 1) extending from the relay inlet port 11 to the downstream side in the conveyance direction. The upper guide 42 and the lower guide 43 are respectively supported on the upper conveyance guide 44 and the lower conveyance guide 45 to be swingable with end portions thereof on the downstream side with respect to the conveyance direction as fulcrums, such that end portions the upper guide 42 and the lower guide 43 on the upstream side (right side in FIG. 3) are swingable upward and downward.

Figure 4:
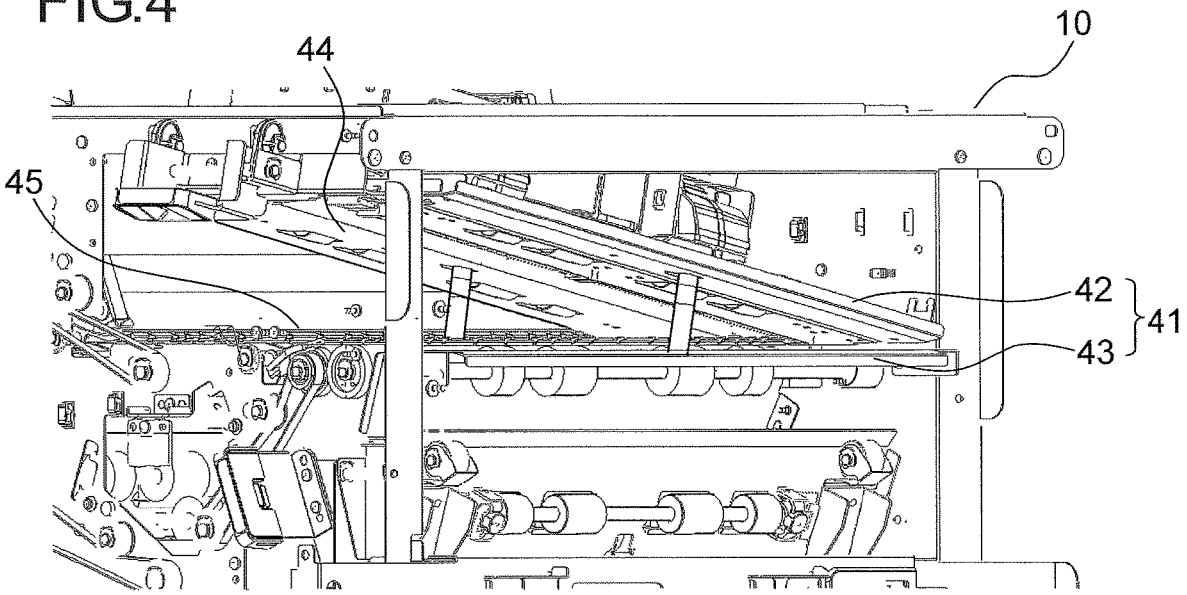
FIG. 4 is a perspective view of the relay conveyance apparatus as seen from the image forming apparatus side, illustrating a state in which an upper conveyance guide is opened.

The upper conveyance guide 44 is supported to be openable and closable with respect to the lower conveyance guide 45, with one end side thereof in a width direction (left-right direction in FIG. 2), which is orthogonal to the conveyance direction, as a fulcrum. FIG. 4 is a perspective view illustrating a state in which the upper conveyance guide 44 is opened, as seen from the image forming apparatus 1 side. In the present embodiment, the upper conveyance guide 44 is openable and closable with a rear surface side (right side in FIG. 4) of the relay conveyance apparatus 10 as a fulcrum. In a case where the paper sheet P having been received via the relay inlet port 11 has caused a jam (paper jam), the upper conveyance guide 44 is rotated upward to open the first conveyance path 12*a*, so that the jammed paper sheet P can be removed easily.

In a state in which the relay conveyance apparatus 10 is connected to the image forming apparatus 1 as illustrated in FIG. 1, a discharge guide 46 on the image forming apparatus 1 side is inserted between the upper guide 42 and the lower guide 43 as illustrated in FIG. 3. With this arrangement, the paper sheet P conveyed by the discharge roller pair 9 (see FIG. 1) is delivered from the discharge guide 46 to the inlet guide 41, and conveyed into the relay conveyance apparatus 10.

Figure 5:
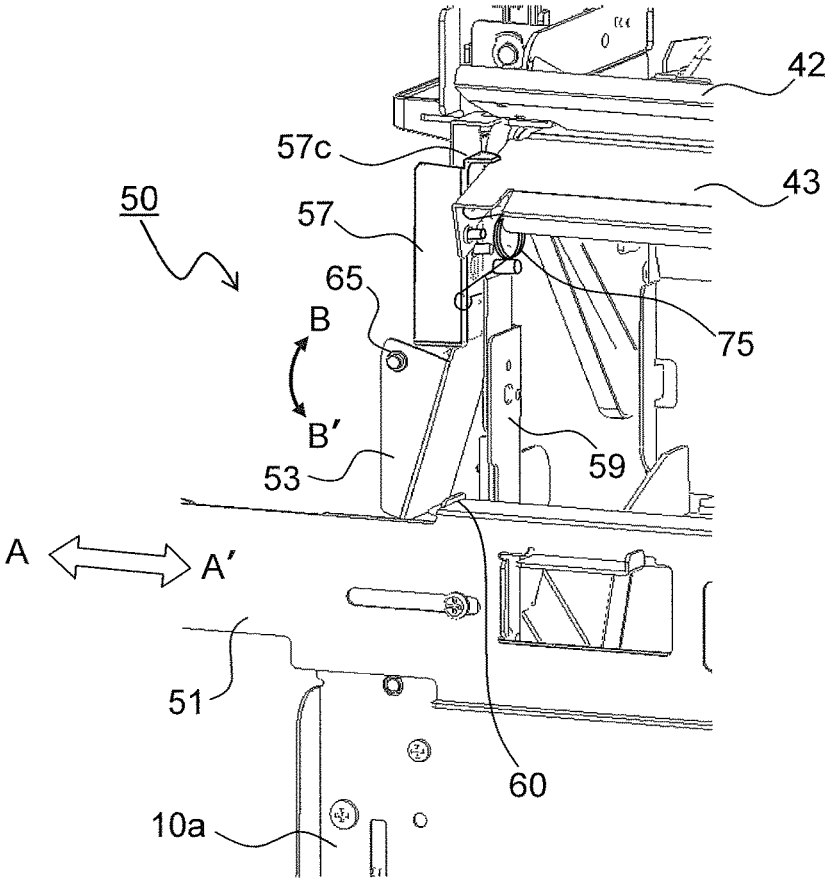
FIG. 5 is an enlarged perspective view of a portion where a slide lever and a first rotation member, which are included in a guide switching mechanism, contact each other.
Figure 8:
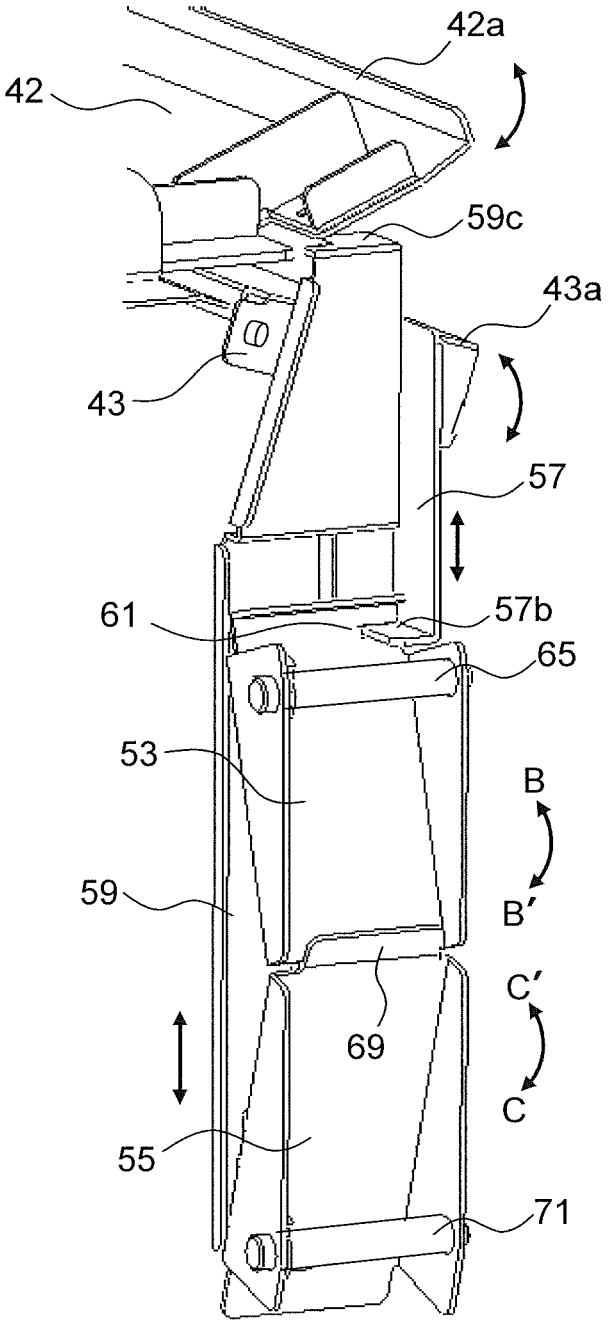
FIG. 8 is a partial perspective view illustrating a state after the upper guide is brought to a separation position by the guide switching mechanism.
Figure 9:
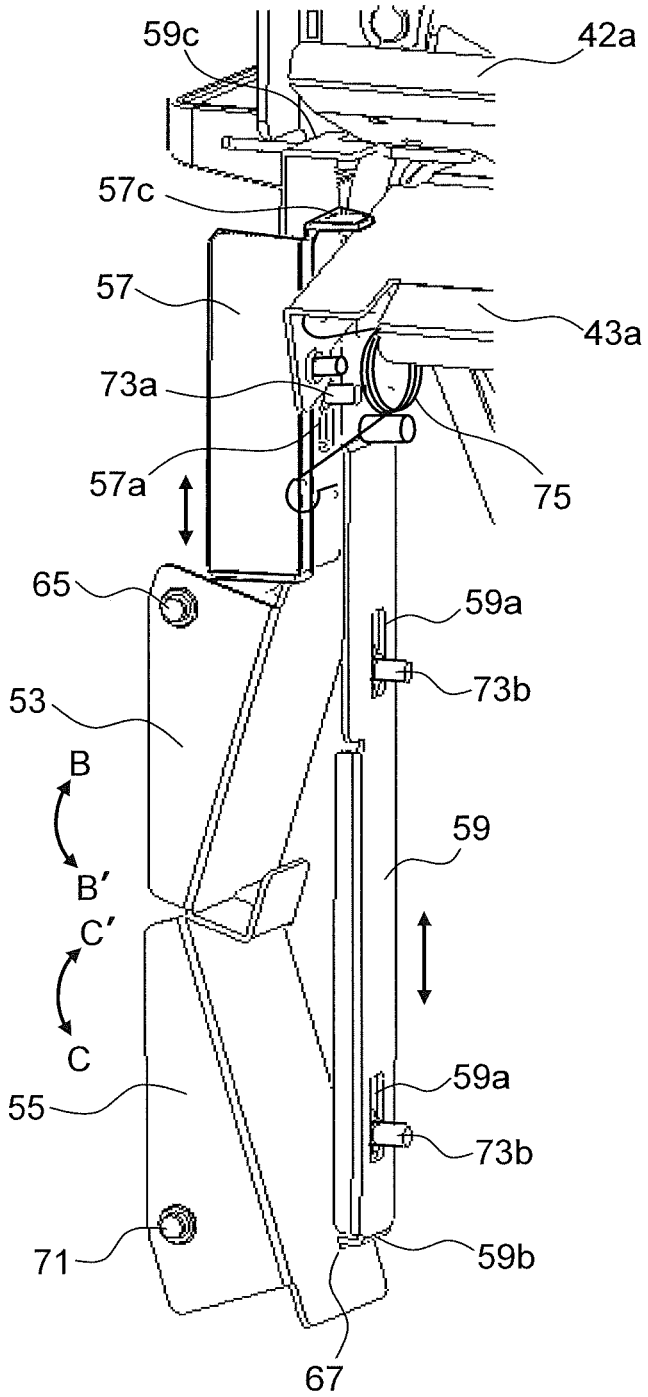
FIG. 9 is a partial perspective view illustrating a state after the lower guide is brought to the separation position by the guide switching mechanism.

Next, a detailed description will be given of a configuration of the guide switching mechanism 50. FIG. 5 is a perspective view of the guide switching mechanism 50 used in the relay conveyance apparatus 10 of the present embodiment, FIG. 6 and FIG. 7 are respectively perspective views of a first rotation member 53 and a second rotation member 55 included in the guide switching mechanism 50, and FIG. 8 and FIG. 9 are partial perspective views illustrating states after the upper guide 42 and the lower guide 43, respectively, are each moved to a separation position by the guide switching mechanism 50.

The guide switching mechanism 50 includes a slide lever 51, the first rotation member 53, the second rotation member 55, a lower guide lever 57, an upper guide lever 59, and a torsion spring (biasing member) 75. The slide lever 51 is supported on the side surface frame 10*a* of the relay conveyance apparatus 10 to be slidable in a front-back direction (arrow-AA' direction) of the relay conveyance apparatus 10.

Figure 6:
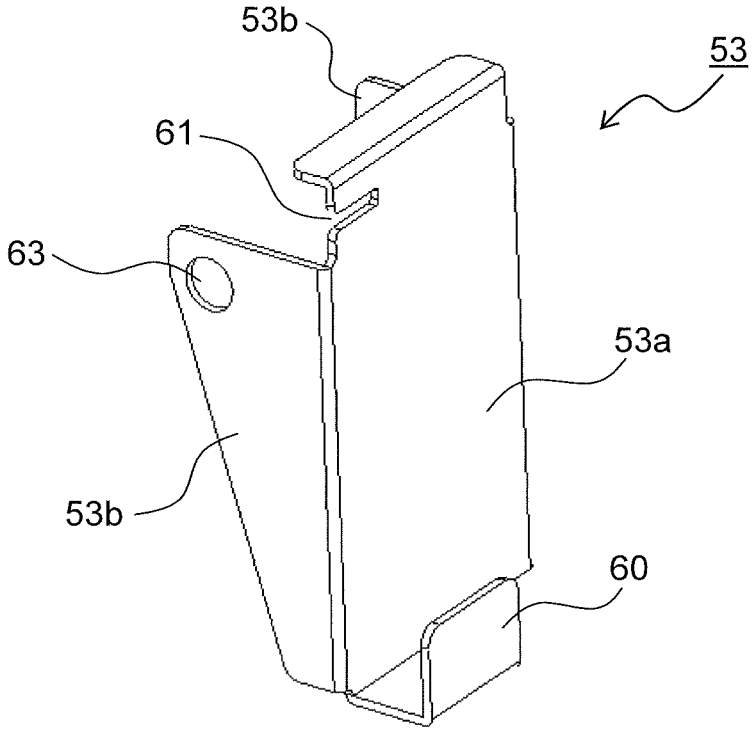
FIG. 6 is a perspective view of the first rotation member included in the guide switching mechanism.

As illustrated in FIG. 6, the first rotation member 53 includes a first main body portion 53*a* having a rectangular shape, and a pair of first side surface portions 53*b* standing substantially vertically on opposite side edges of the first main body portion 53*a*. At a lower end portion of the first main body portion 53*a*, there is provided a connection portion 60 which is connected to the slide lever 51. At an upper end portion of the first main body portion 53*a*, there is provided a first slit 61 to which the lower guide lever 57 is connected. First bearing holes 63 are formed one in each of the pair of first side surface portions 53*b*. Through the first bearing holes 63, there is rotatably inserted a first support shaft 65 (see FIG. 8) which is fixed to a main body frame (not shown) of the relay conveyance apparatus 10. With this arrangement, the first rotation member 53 is rotatably supported with respect to the main body frame.

Figure 7:
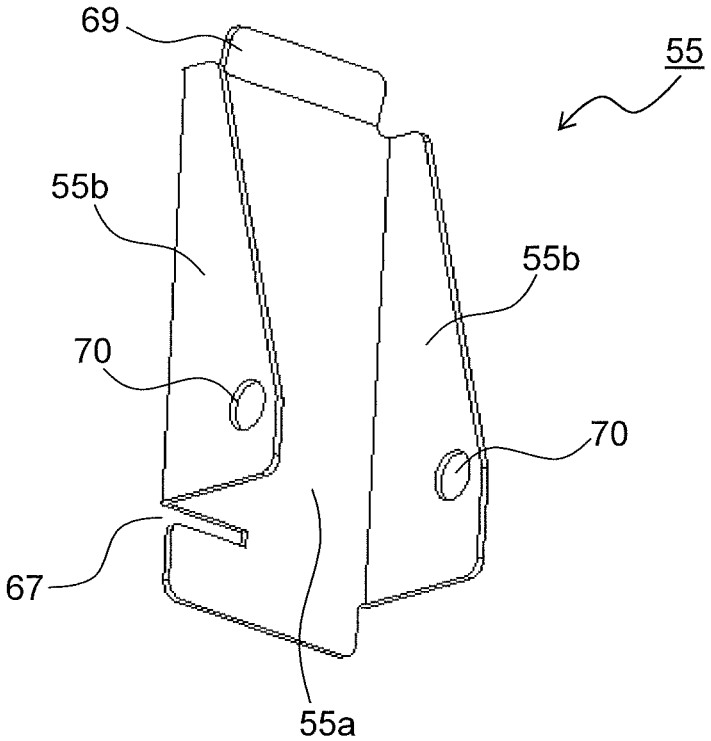
FIG. 7 is a perspective view of a second rotation member included in the guide switching mechanism.

The second rotation member 55 has a shape vertically reverse to the shape of the first rotation member 53, and, as illustrated in FIG. 7, the second rotation member 55 has a second main body portion 55*a* having a rectangular shape and a pair of second side surface portions 55*b* standing substantially vertically on opposite edges of the second main body portion 55*a*. At a lower end portion of the second main body portion 55*a*, there is provided a second slit 67 to which the upper guide lever 59 is connected. At an upper end portion of the second main body portion 55*a*, there is provided a pressed portion 69 which a rotation end (connection portion 60) of the first rotation member 53 contacts. Second bearing holes 70 are formed one in each of the pair of second side surface portions 55*b*. Through the second bearing holes 70, there is rotatably inserted a second support shaft 71 (see FIG. 8) which is fixed to the main body frame (not shown) of the relay conveyance apparatus 10. With this arrangement, the second rotation member 55 is rotatably supported with respect to the main body frame.

The lower guide lever 57 is a link member which connects the first rotation member 53 and the lower guide 43 to each other. As illustrated in FIG. 8, at a lower end portion of the lower guide lever 57, there is formed a first connection piece 57*b* which is connected to the first slit 61 of the first rotation member 53. As illustrated in FIG. 9, at an upper end portion of the lower guide lever 57, there is formed an engagement piece 57*c* which engages with a swing end 43*a* of the lower guide 43. Further, in the lower guide lever 57, there is formed an elongated hole 57*a* extending in an up-down direction. In the elongated hole 57*a*, there engages an engagement pin 73*a* which is fixed to the main body frame, and thereby, the lower guide lever 57 is supported to be vertically slidable with respect to the main body frame. Below the lower guide 43, the torsion spring 75 is disposed. The torsion spring 75 biases the swing end 43*a* of the lower guide 43 upward.

The upper guide lever 59 is a link member which connects the second rotation member 55 and the upper guide 42 to each other. As illustrated in FIG. 8, at an upper end portion of the upper guide lever 59, there is formed a push-up piece 59*c* which pushes up a swing end 42*a* of the upper guide 42. As illustrated in FIG. 9, at a lower end portion of the upper guide lever 59, there is formed a second connection piece 59*b* which is connected to the second slit 67 of the second rotation member 55. Further, in the upper guide lever 59, there are formed two elongated holes 59*a* extending in the up-down direction. Engagement pins 73*b*, which are fixed to the main body frame, engage with the elongated holes 59*a*, and thereby, the upper guide lever 59 is supported to be vertically slidable with respect to the main body frame.

Next, a description will be given of a procedure of switching the inlet guide 41 when connecting the relay conveyance apparatus 10 of the present embodiment to the image forming apparatus 1. First, the slide lever 51 is pulled out toward the front side of the relay conveyance apparatus 10 (in the arrow-A direction in FIG. 5). As a result, the connection portion 60 of the first rotation member 53 moves in the arrow-A direction together with the slide lever 51, and the first rotation member 53 rotates in the arrow-B direction with the first support shaft 65 as a fulcrum.

Along with the rotation of the first rotation member 53 in the arrow-B direction, as illustrated in FIG. 8 and FIG. 9, the lower guide lever 57, which is connected to the first slit 61 of the first rotation member 53, is pulled down. Thereby, also the swing end 43*a* of the lower guide 43, with which the engagement piece 57*c* of the lower guide lever 57 engages, is caused to rotate downward against the biasing force of the torsion spring 75.

On the other hand, as illustrated in FIG. 8, the pressed portion 69 of the second rotation member 55 is pressed by the connection portion 60 of the first rotation member 53, and the second rotation member 55 rotates in the arrow-C direction with the second support shaft 71 as a fulcrum. Along with the rotation of the second rotation member 55 in the arrow-C direction, the upper guide lever 59, which is connected to the second slit 67 of the second rotation member 55, is pushed up. Consequently, the push-up piece 59*c* of the upper guide lever 59 pushes the swing end 42*a* of the upper guide 42 upward, and the swing end 42*a* of the upper guide 42 is caused to rotate upward.

Figure 10:
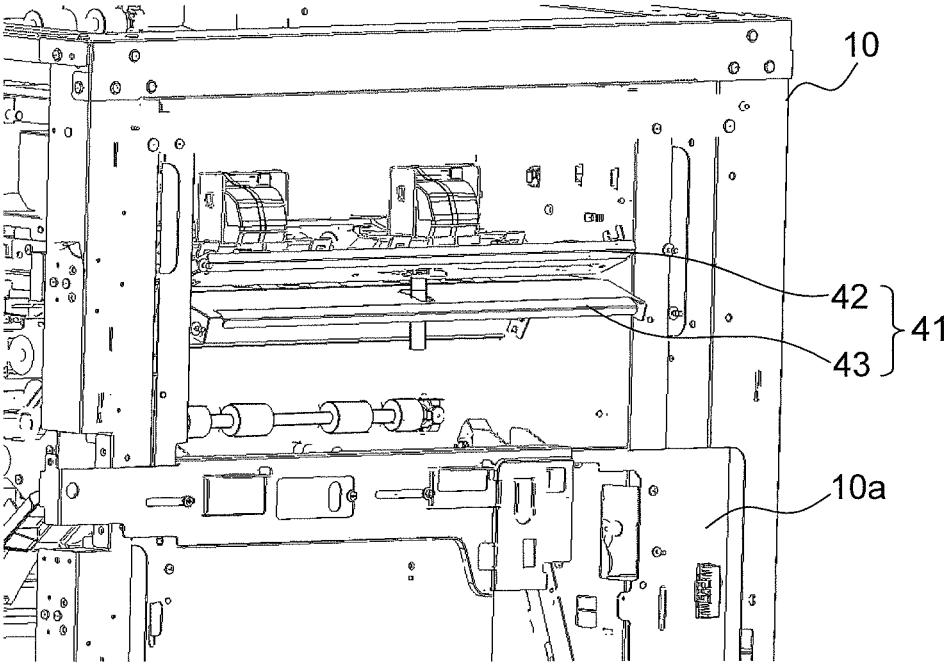
FIG. 10 is a perspective view of the relay conveyance apparatus as seen from the image forming apparatus side, illustrating a state in which the upper guide and the lower guide are disposed at the separation position.
Figure 11:
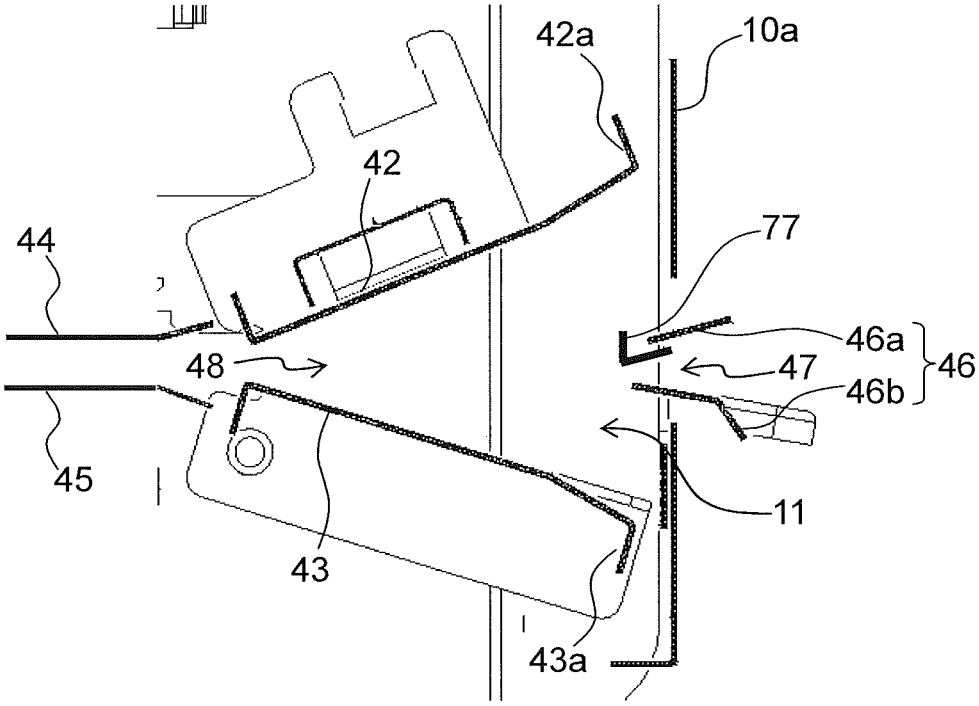
FIG. 11 is a side sectional view of the relay conveyance apparatus taken near the relay inlet port, illustrating a state in which the upper guide and the lower guide are disposed at the separation position.
Figure 12:
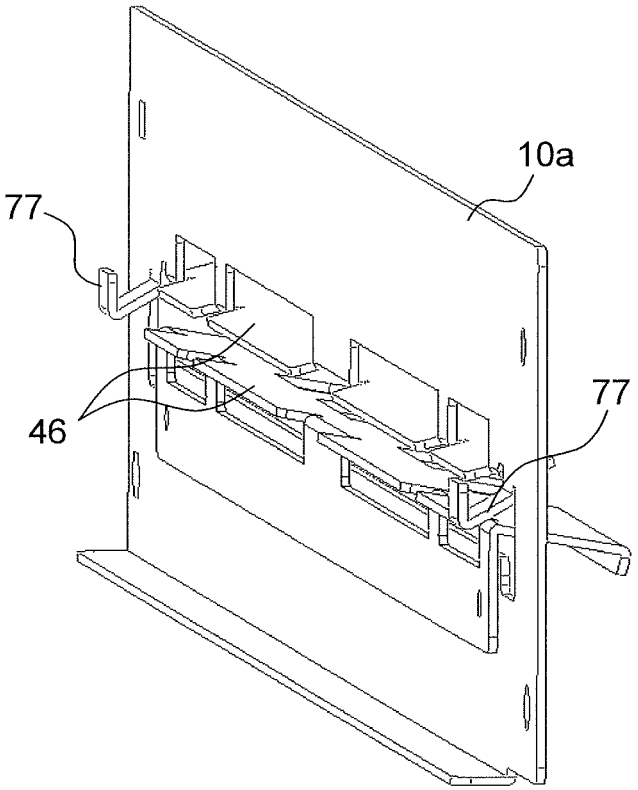
FIG. 12 is a perspective view illustrating, as seen from inside the relay conveyance apparatus, a state in which a discharge guide on the image forming apparatus side is inserted between the upper guide and the lower guide.

According to the above procedure, as illustrated in FIG. 10 and FIG. 11, the inlet guide 41 is brought to a position (separation position) at which the inlet guide 41 is opened on the upstream side (right side in FIG. 11) in the conveyance direction. In this state, the discharge guide 46 on the image forming apparatus 1 side is inserted between the upper guide 42 and the lower guide 43 (a second distance). FIG. 12 is a perspective view illustrating, as seen from inside the relay conveyance apparatus 10, a state in which the discharge guide 46 on the image forming apparatus 1 side is inserted between the upper guide 42 and the lower guide 43.

Then, the slide lever 51 is pushed toward the rear surface side of the relay conveyance apparatus 10 (the arrow-A' direction in FIG. 5). As a result, the connection portion 60 of the first rotation member 53 moves in the arrow-A' direction together with the slide lever 51, and this causes the first rotation member 53 to rotate in the arrow-B' direction with the first support shaft 65 as a fulcrum.

Along with the rotation of the first rotation member 53 in the arrow-B' direction, the lower guide lever 57 connected to the first slit 61 of the first rotation member 53 is pushed up. Consequently, the engagement piece 57*c* of the lower guide lever 57 moves upward, and this allows the biasing force of the torsion spring 75 to cause the swing end 43*a* of the lower guide 43 to rotate upward.

Further, the pressing force on the pressed portion 69 from the connection portion 60 of the first rotation member 53 disappears, and as a result, the self weight of the upper guide lever 59 causes the second rotation member 55 to rotate in the arrow-C' direction with the second support shaft 71 as a fulcrum. Consequently, the push-up piece 59*c* of the upper guide lever 59 moves downward, and this allows the self weight of the upper guide 42 to cause the swing end 42*a* to rotate downward.

By the swing end 42*a* of the upper guide 42 coming into contact with a restriction portion 77, the downward rotation of the swing end 42*a* is restricted. Further, as for the swing end 43*a* of the lower guide 43, its upward rotation is restricted by the engagement piece 57*c* of the lower guide lever 57. Consequently, as illustrated in FIG. 3, the inlet guide 41 is brought to a position (conveyance position) at which the upper guide 42 and the lower guide 43 face each other with a predetermined distance (a first distance) therebetween on the upstream side (right side in FIG. 3) in the conveyance direction. In a case where the vertical center of a discharge path 47 formed by the discharge guide 46 substantially coincides with the vertical center of an inlet path 48 formed by the upper guide 42 and the lower guide 43 of the inlet guide 41 disposed at the conveyance position, as illustrated in FIG. 3, a discharge upper guide 46*a* of the discharge guide 46 is located below the upper guide 42, and a discharge lower guide 46*b* of the discharge guide 46 is located above the lower guide 43.

In a case where the vertical center of the discharge path 47 is located at a higher position than the vertical center of the inlet path 48, a lower surface of the swing end 42*a* of the upper guide 42 is pushed up by the discharge upper guide 46*a* of the discharge guide 46, and moves away from the restriction portion 77. Further, the swing end 43*a* of the lower guide 43 is caused, by the biasing force of the torsion spring 75, to rotate upward in a state where the swing end 43*a* is in contact with a lower surface of the discharge lower guide 46*b* of the discharge guide 46.

In a case where the vertical center of the discharge path 47 is located at a lower position than the vertical center of the inlet path 48, an upper surface of the swing end 43*a* of the lower guide 43 is pushed down by the discharge lower guide 46*b* of the discharge guide 46 against the biasing force of the torsion spring 75, and rotates downward in a state where the swing end 43*a* is in contact with the lower surface of the discharge lower guide 46*b* of the discharge guide 46. At this time, the swing end 42*a* of the upper guide 42 is supported by the restriction portion 77, and thus there is formed a space between the swing end 42*a* of the upper guide 42 and an upper surface of the discharge guide 46. However, since the discharge guide 46 is inserted between the upper guide 42 and the lower guide 43, there is no risk of the paper sheet P being caught between the discharge guide 46 and the upper guide 42.

According to the configuration of the present embodiment, to connect the relay conveyance apparatus 10 to the image forming apparatus 1, the discharge guide 46 located on the upstream side with respect to the conveyance direction is inserted into the inlet guide 41 located on the downstream side with respect to the conveyance direction. This helps achieve smooth delivery of the paper sheet P from the discharge guide 46 to the inlet guide 41.

Further, by pulling out the slide lever 51 to bring the inlet guide 41 of the relay conveyance apparatus 10 to the separation position, it is possible to insert the discharge guide 46 smoothly between the upper guide 42 and the lower guide 43 of the inlet guide 41. And, by pushing in the slide lever 51 to bring the inlet guide 41 to the conveyance position, the inlet guide 41 and the discharge are securely connected to each other.

Accordingly, even in a case where the state of an installation surface does not allow the height position of the inlet guide 41 on the relay conveyance apparatus 10 side and that of the discharge guide 46 on the image forming apparatus 1 side to completely coincide with each other, it is possible to effectively reduce occurrence of conveyance failure of the paper sheet P ascribable to difference in height position between the inlet guide 41 and the discharge guide 46. Further, since there is no need of adjusting the height of the image forming apparatus 1 or of the relay conveyance apparatus 10, it is possible to significantly reduce the time for the installation.

The embodiments described above are in no way meant to limit the present disclosure, which thus allows for many modifications and variations within the spirit of the present disclosure. For example, in the embodiment described above, an example has been dealt with where the present disclosure is applied to the connecting of the image forming apparatus 1 and the relay conveyance apparatus 10 to each other, but the present disclosure is also applicable to the connecting of the relay conveyance apparatus 10 and the sheet post-processing apparatus 20 to each other, or, to the connecting of the image forming apparatus 1 and an insert apparatus to each other in connecting the insert apparatus, which supplies an insert sheet in an interval between sheet supplies from the image forming apparatus 1 to the relay conveyance apparatus 10.

For example, the present disclosure is applicable to the connecting of the relay conveyance apparatus 10 and the sheet post-processing apparatus 20 to each other by providing the inlet guide 41, which includes the upper guide 42 and the lower guide 43, at the sheet inlet port 21 of the sheet post-processing apparatus 20, and providing the discharge guide 46 at the relay outlet port 16 of the relay conveyance apparatus 10.

Further, the embodiment described above has dealt with an inkjet printer as an example of the image forming apparatus 1, but needless to say, the present disclosure is also applicable to image forming apparatuses other than inkjet printers, such as copiers, laser printers, facsimile machines, etc.

The present disclosure is applicable to a sheet conveyance unit which is attachably and detachably connected to an upstream-side apparatus such as an image forming apparatus, and which conveys a sheet received from the upstream-side apparatus to the downstream side.

Use of the present disclosure makes it possible to provide a sheet conveyance unit capable of receiving a sheet from an upstream-side apparatus easily and securely, regardless of the state of an installation surface or the kind of a sheet.

What is claimed is:

1. A sheet conveyance unit being connected to a sheet discharge unit which discharge a sheet, the sheet conveyance unit comprising:

a sheet inlet port which is connected to a discharge guide provided in the sheet discharge unit;

an inlet guide which is disposed at the sheet inlet port and has an upper guide facing an upper surface of the sheet and a lower guide disposed below the upper guide so as to face a lower surface of the sheet;

a conveyance member which conveys the sheet conveyed into the sheet conveyance unit along the inlet guide; and a guide switching mechanism which switches the inlet guide between a conveyance position at which the upper guide and the lower guide face each other with a first distance and a separation position at which the upper guide and the lower guide are spaced from each other with a second distance greater than the first distance, wherein, to connect the sheet conveyance unit to the sheet discharge unit, the inlet guide is disposed to the separation position by the guide switching mechanism before the discharge guide is inserted between the upper guide and the lower guide, and is disposed to the conveyance position after the discharge guide is inserted between the upper guide and the lower guide.

2. The sheet conveyance unit according to claim 1, wherein the upper guide and the lower guide are each supported to be swingable upward and downward with a downstream side thereof with respect to a sheet conveyance direction as a fulcrum and with an upstream side thereof with respect to the sheet conveyance direction as a swing end, and the guide switching mechanism swings the swing end of the upper guide and the swing end of the lower guide in directions away from each other at the conveyance position, to thereby switch the position of the inlet guide to the separation position, and swings the swing end of the upper guide and the swing end of the lower guide in directions approaching each other at the separation position, to thereby switch the position of the inlet guide to the conveyance position.

3. The sheet conveyance unit according to claim 2, wherein the guide switching mechanism comprises a slide lever which is supported to be slidable in a horizontal direction, an upper guide lever which is supported, below the swing end of the upper guide, to be slidable upward and downward, a lower guide lever having an engagement piece which engages with an upper surface of the swing end of the lower guide and is supported to be slidable upward and downward, a first rotation member which is connected to the lower guide lever and is rotated by sliding of the slide lever, a second rotation member which is connected to the upper guide lever and is rotated by rotation of the first rotation member in a direction reverse to a direction in which the first rotation member rotates, and a biasing member which biases the swing end of the lower guide upward, the inlet guide is brought to the separation position by sliding the slide lever in a predetermined direction to cause the first rotation member to rotate in a first direction to move the lower guide lever downward to swing the swing end of the lower guide downward against biasing force of the biasing member, and to cause the second rotation member to rotate in a second direction, which is a direction reverse to the first direction, to move the upper guide lever upward to swing the swing end of the upper guide upward, and the inlet guide is brought to the conveyance position by sliding the slide lever in a direction reverse to the predetermined direction to cause the first rotation member to rotate in the second direction to move the lower guide lever upward to allow the biasing force of the biasing member to cause the swing end of the lower guide to swing upward, and to cause the second rotation member to rotate in the first direction to move the upper guide lever downward to allow self weight of the swing end of the upper guide to cause the swing end of the upper guide to swing downward.

4. The sheet conveyance unit according to claim 3, further comprising a restriction portion which restricts downward rotation of the swing end of the upper guide caused by the self weight thereof.

5. The sheet conveyance unit according to claim 4, wherein the discharge guide includes a discharge upper guide which faces the upper guide and a discharge lower guide which faces the lower guide, when the discharge guide is inserted between the upper guide and the lower guide of the inlet guide at the conveyance position, in a case where a vertical center of a discharge path formed by the discharge guide substantially coincides with a vertical center of an inlet path formed by the upper guide and the lower guide of the inlet guide at the conveyance position, the discharge upper guide is located below the upper guide and the discharge lower guide is located above the lower guide, in a case where the vertical center of the discharge path is located at a higher position than the vertical center of the inlet path, the swing end of the upper guide is pushed up by the discharge upper guide to move away from the restriction portion, and the swing end of the lower guide is caused by the biasing force of the biasing member to rotate upward while being in contact with a lower surface of the discharge lower guide, and in a case where the vertical center of the discharge path is located at a lower position than the vertical center of the inlet path, the swing end of the lower guide is pushed down by the discharge lower guide against the biasing force of the biasing member to rotate downward while being in contact with the lower surface of the discharge lower guide, with the swing end of the upper guide supported by the restriction member.

6. The sheet conveyance unit according to claim 2, further comprising a conveyance guide which is disposed on a downstream side of the inlet guide in the sheet conveyance direction and includes an upper conveyance guide on which the upper guide is swingably supported, and a lower conveyance guide on which the lower guide is swingably supported, the upper conveyance guide is rotatable upward and downward with one end side thereof in a width direction orthogonal to the sheet conveyance direction as a fulcrum, and the conveyance guide is opened by rotating the upper conveyance guide upward.

7. A sheet conveyance system comprising:

the sheet conveyance unit according to claim 1; and the sheet discharge unit which is connected to an upstream side of the sheet conveyance unit with respect to the sheet conveyance direction, and which has the discharge guide which is connected to the inlet guide.

* * * * *